US009071906B2

(12) United States Patent
Hogue et al.

(10) Patent No.: US 9,071,906 B2
(45) Date of Patent: Jun. 30, 2015

(54) WIRELESS AUDIO PLAYER AND SPEAKER SYSTEM

(71) Applicant: Imation Corp., Oakdale, MN (US)

(72) Inventors: Douglas K. Hogue, Woodbury, MN (US); John Bruss, St. Paul, MN (US); Al Olson, Cottage Grove, MN (US)

(73) Assignee: Imation Corp., Oakdale, MN (US)

( * ) Notice: Subject to any disclaimer, the term of this patent is extended or adjusted under 35 U.S.C. 154(b) by 133 days.

(21) Appl. No.: 13/737,172

(22) Filed: Jan. 9, 2013

(65) Prior Publication Data

US 2013/0177198 A1 Jul. 11, 2013

Related U.S. Application Data

(60) Provisional application No. 61/584,605, filed on Jan. 9, 2012.

(51) Int. Cl.

| | |
|---|---|
| ***H04R 3/12*** | (2006.01) |
| ***H04R 5/04*** | (2006.01) |
| ***H04R 27/00*** | (2006.01) |
| *H04R 1/28* | (2006.01) |
| *H04R 29/00* | (2006.01) |

(52) U.S. Cl.

CPC ..... *H04R 3/12* (2013.01); *H04R 1/2834* (2013.01); *H04R 5/04* (2013.01); *H04R 27/00* (2013.01); *H04R 29/008* (2013.01); *H04R 2227/005* (2013.01); *H04R 2420/07* (2013.01); *H04R 2430/01* (2013.01)

(58) Field of Classification Search

CPC ..... H04R 1/403; H04R 2420/07; H04R 1/323

USPC ..... 381/300, 311, 334; 455/41.2, 569.1

See application file for complete search history.

(56) References Cited

U.S. PATENT DOCUMENTS

| | | | | |
|---|---|---|---|---|
| 2,544,742 | A * | 3/1951 | Volf | 181/145 |
| 3,725,583 | A * | 4/1973 | Gunderson et al. | 381/98 |
| D230,194 | S | 1/1974 | Buckler | |
| 4,179,585 | A * | 12/1979 | Herrenschmidt | 381/182 |
| D268,673 | S | 4/1983 | Iijima | |
| 4,418,243 | A * | 11/1983 | Fixler | 381/308 |
| D361,071 | S | 8/1995 | Mark | |
| 5,502,772 | A * | 3/1996 | Felder | 381/386 |
| D444,457 | S | 7/2001 | Kuo | |
| D461,187 | S | 8/2002 | Andre et al. | |
| D476,308 | S | 6/2003 | Bhavnani | |
| D527,722 | S | 9/2006 | Yeh | |
| D535,942 | S | 1/2007 | Kim | |
| 7,212,110 | B1 | 5/2007 | Martin et al. | |
| D551,652 | S | 9/2007 | Nakamura | |
| D552,053 | S | 10/2007 | Kim | |

(Continued)

OTHER PUBLICATIONS

Filing Receipt for U.S. Appl. No. 61/569,806, filed Dec. 13, 2011.

(Continued)

*Primary Examiner* — Curtis Kuntz
*Assistant Examiner* — Ryan Robinson
(74) *Attorney, Agent, or Firm* — Dorsey & Whitney LLP

(57) ABSTRACT

The present disclosure relates to an audio player and speaker system, and particularly, to a wireless audio player and speaker system. More particularly, the present disclosure relates to a semi-permanent, wireless boombox-style audio player, for playing audio from an external audio source.

21 Claims, 9 Drawing Sheets

(56) References Cited

U.S. PATENT DOCUMENTS

| | | | | |
|---|---|---|---|---|
| D571,356 | S | 6/2008 | Smith | |
| D575,766 | S | 8/2008 | Harris | |
| D578,510 | S | 10/2008 | Tanaka | |
| D596,156 | S | 7/2009 | Morisawa | |
| D607,283 | S | 1/2010 | Mahan et al. | |
| D610,569 | S | 2/2010 | Fiebel et al. | |
| 7,689,197 | B2 | 3/2010 | Laude et al. | |
| 7,702,952 | B2 * | 4/2010 | Tarra et al. | 714/6.11 |
| D617,775 | S | 6/2010 | Chae et al. | |
| D621,813 | S | 8/2010 | Wang et al. | |
| D624,527 | S | 9/2010 | Ho et al. | |
| D629,827 | S | 12/2010 | Morenstein et al. | |
| 7,953,239 | B2 | 5/2011 | Decanio | |
| D645,847 | S | 9/2011 | Chau | |
| D646,665 | S | 10/2011 | Iijima | |
| 8,086,332 | B2 * | 12/2011 | Dorogusker et al. | 700/94 |
| D654,473 | S | 2/2012 | Paddock | |
| D657,343 | S | 4/2012 | Cho et al. | |
| 8,180,095 | B2 | 5/2012 | Zhang | |
| D664,122 | S | 7/2012 | Cho et al. | |
| 8,391,510 | B2 * | 3/2013 | Vincenot | 381/97 |
| 2003/0231189 | A1 | 12/2003 | Williams | |
| 2004/0014426 | A1 | 1/2004 | Moore | |
| 2006/0050907 | A1 * | 3/2006 | Levitsky | 381/304 |
| 2007/0076911 | A1 | 4/2007 | Schul et al. | |
| 2007/0098191 | A1 | 5/2007 | Wan et al. | |
| 2007/0173294 | A1 * | 7/2007 | Hsiung | 455/569.1 |
| 2008/0025172 | A1 | 1/2008 | Holden et al. | |
| 2010/0046771 | A1 | 2/2010 | Gregg et al. | |
| 2010/0194335 | A1 | 8/2010 | Kirby et al. | |
| 2011/0297566 | A1 | 12/2011 | Gallagher et al. | |
| 2012/0051567 | A1 | 3/2012 | Castor-Perry | |
| 2012/0075789 | A1 | 3/2012 | DeCamp et al. | |
| 2012/0170212 | A1 | 7/2012 | Gallouzi et al. | |
| 2012/0189156 | A1 | 7/2012 | Leung | |
| 2012/0194448 | A1 | 8/2012 | Rothkopf | |
| 2012/0229380 | A1 | 9/2012 | Silvester | |
| 2012/0250924 | A1 * | 10/2012 | Nicholson et al. | 381/334 |
| 2012/0300962 | A1 * | 11/2012 | Devoto | 381/300 |
| 2012/0321120 | A1 | 12/2012 | Han et al. | |
| 2012/0325702 | A1 | 12/2012 | Gallagher et al. | |
| 2013/0033807 | A1 | 2/2013 | Kim | |
| 2013/0038634 | A1 | 2/2013 | Yamada et al. | |
| 2013/0058065 | A1 | 3/2013 | Minaguchi et al. | |
| 2013/0072265 | A1 | 3/2013 | Deluca | |
| 2013/0080762 | A1 | 3/2013 | Cretella, Jr. et al. | |
| 2013/0109253 | A1 | 5/2013 | Gammon et al. | |
| 2013/0178155 | A1 | 7/2013 | Shulenberger | |
| 2013/0178161 | A1 | 7/2013 | Shulenberger | |

OTHER PUBLICATIONS

Filing Receipt and application for Israeli Design Application 51531, filed Nov. 11, 2011.
Design U.S. Appl. No. 29/410,496, filed Jan. 9, 2012.
Design U.S. Appl. No. 29/410,493, filed Jan. 9, 2012.
Design U.S. Appl. No. 29/410,487, filed Jan. 9, 2012.
U.S. Appl. No. 13/737,241, filed Jan. 9, 2013.
U.S. Appl. No. 13/737,365, filed Jan. 9, 2013.

* cited by examiner

WIRELESS AUDIO PLAYER AND SPEAKER SYSTEM

CROSS-REFERENCE TO RELATED APPLICATIONS

This application claims priority to U.S. Provisional Application No. 61/584,605, filed Jan. 9, 2012, the content of all of which is hereby incorporated in its entirety by reference.

Inventions described in this application can also be used in combination or conjunction, or otherwise, with the subject matter described in one or more of the following:

U.S. patent application Ser. No. 13/737,365, filed Jan. 9, 2013, entitled "WIRELESS AUDIO PLAYER AND SPEAKER SYSTEM," which claims priority to U.S. Provisional Application 61/584,609, filed Jan. 9, 2012; and U.S. patent application Ser. No. 13/737,241, filed Jan. 9, 2013, entitled "AUDIO SPEAKER FRAME FOR MULTIMEDIA DEVICE," which claims priority to U.S. Provisional Application 61/584,596, filed Jan. 9, 2012.

Each and every one of these documents is hereby incorporated by reference as if fully set forth herein.

FIELD OF THE INVENTION

The present disclosure relates to an audio player and speaker system, and particularly, to a wireless audio player and speaker system. More particularly, the present disclosure relates to a semi-permanent, wireless boombox-style audio player, for playing audio from an external audio source.

While multiple embodiments are disclosed, still other embodiments of the present disclosure will become apparent to those skilled in the art from the following detailed description, which shows and describes illustrative embodiments of the disclosure. As will be realized, the various embodiments of the present disclosure are capable of modifications in various obvious aspects, all without departing from the spirit and scope of the present disclosure. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the various embodiments of the present disclosure, it is believed that the embodiments will be better understood from the following description taken in conjunction with the accompanying Figures, in which:

DETAILED DESCRIPTION

The present disclosure relates to novel and advantageous player and speaker systems, and particularly, to wireless player and speaker systems. In some embodiments, the systems are audio systems. In some embodiments, the present disclosure relates to novel and advantageous semi-permanent, wireless boombox-style audio players, for playing audio from an external audio source.

In general, an audio player and speaker system of the present disclosure may include one or more speakers and may be configured to receive and play audio from an external audio source, such as a portable or external media player, by wired and/or wireless connection. Portable or external media players may include any type of media playback device, including audio playback devices, such as but not limited to, an iPod or similar device, a mobile phone or smartphone device, tablet PCs, etc., as will be recognized by those skilled in the art. The audio player and speaker system may be connected to an external power source. The audio player and speaker system may also be configured for recharging the portable external media player or other external device.

Figure 1:
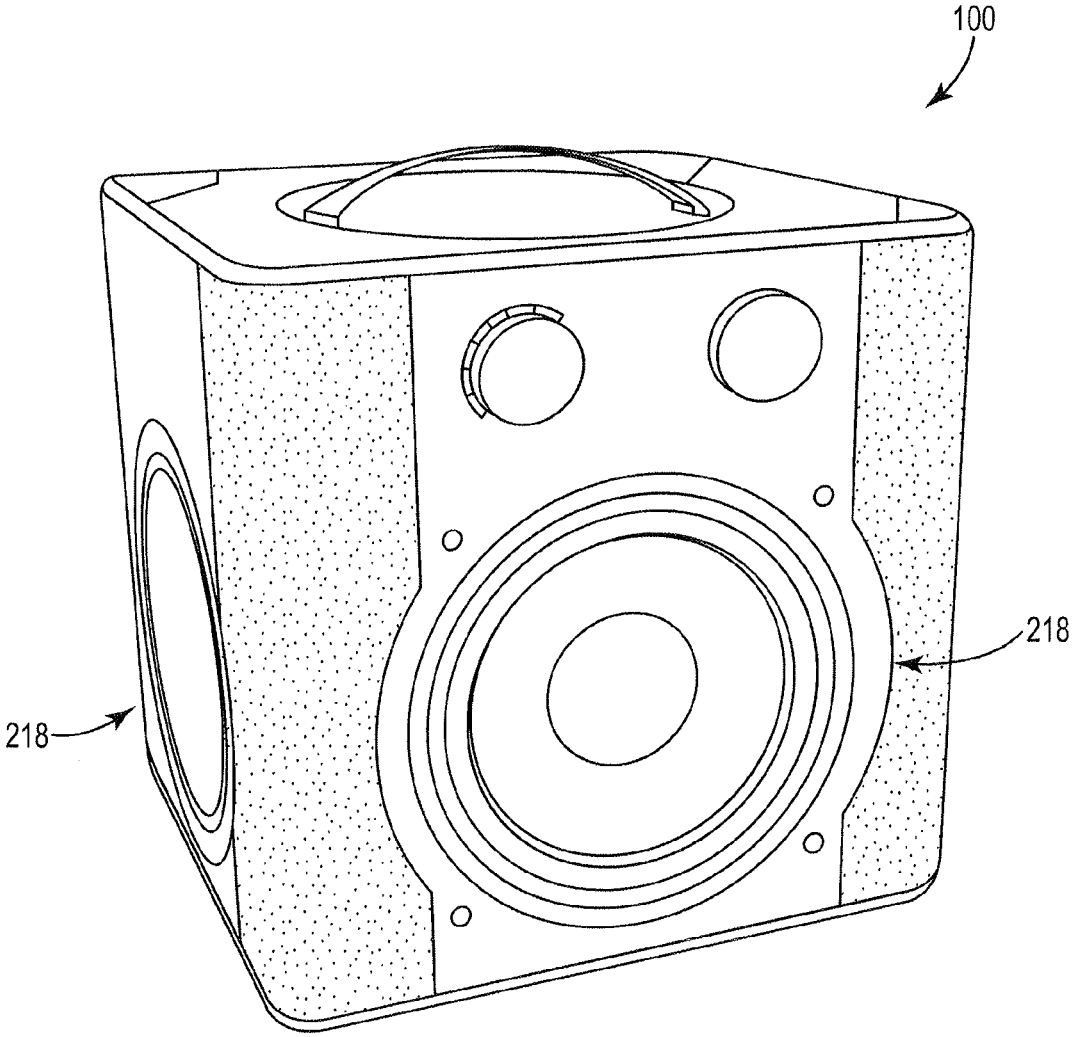
FIG. 1 is a perspective view of an audio player and speaker system according to an embodiment of the present disclosure.
Figure 8:
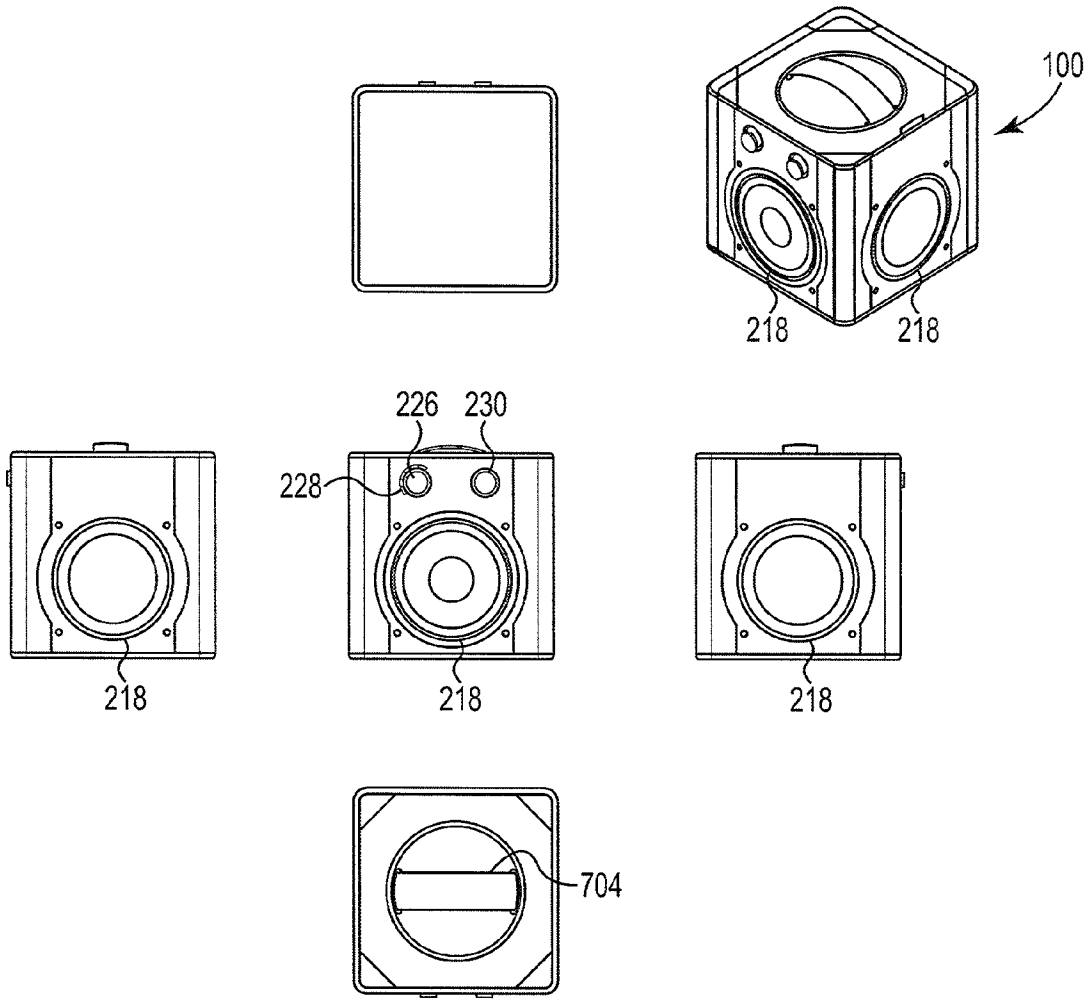
FIG. 8 includes several schematic drawings of an audio player and speaker system according to an embodiment of the present disclosure.

FIGS. 1 and 8 illustrate one embodiment of an audio player and speaker system 100 of the present disclosure. The audio player and speaker system 100 may be or include a housing configured in any suitable shape, such as but not limited to, cubical, as a rectangular polygon or rectangular prism, polygonal, triangular, spherical or semi-spherical, etc., each with any number of corners or edges that may be sharp or more smooth, rounded corners or edges. As illustrated, and in accordance with one embodiment, the audio player and speaker system 100 may be configured in substantially the shape of a cube with each side being generally dimensioned the same, and generally including softened or rounded edges and corners. In some embodiments, the audio player and speaker system 100 may be configured for indoor use only. However, it is certainly recognized that the audio player and speaker system 100 may be manufactured using water-resistant construction materials and methods and accordingly be also suitable for outdoor use.

Figure 2:
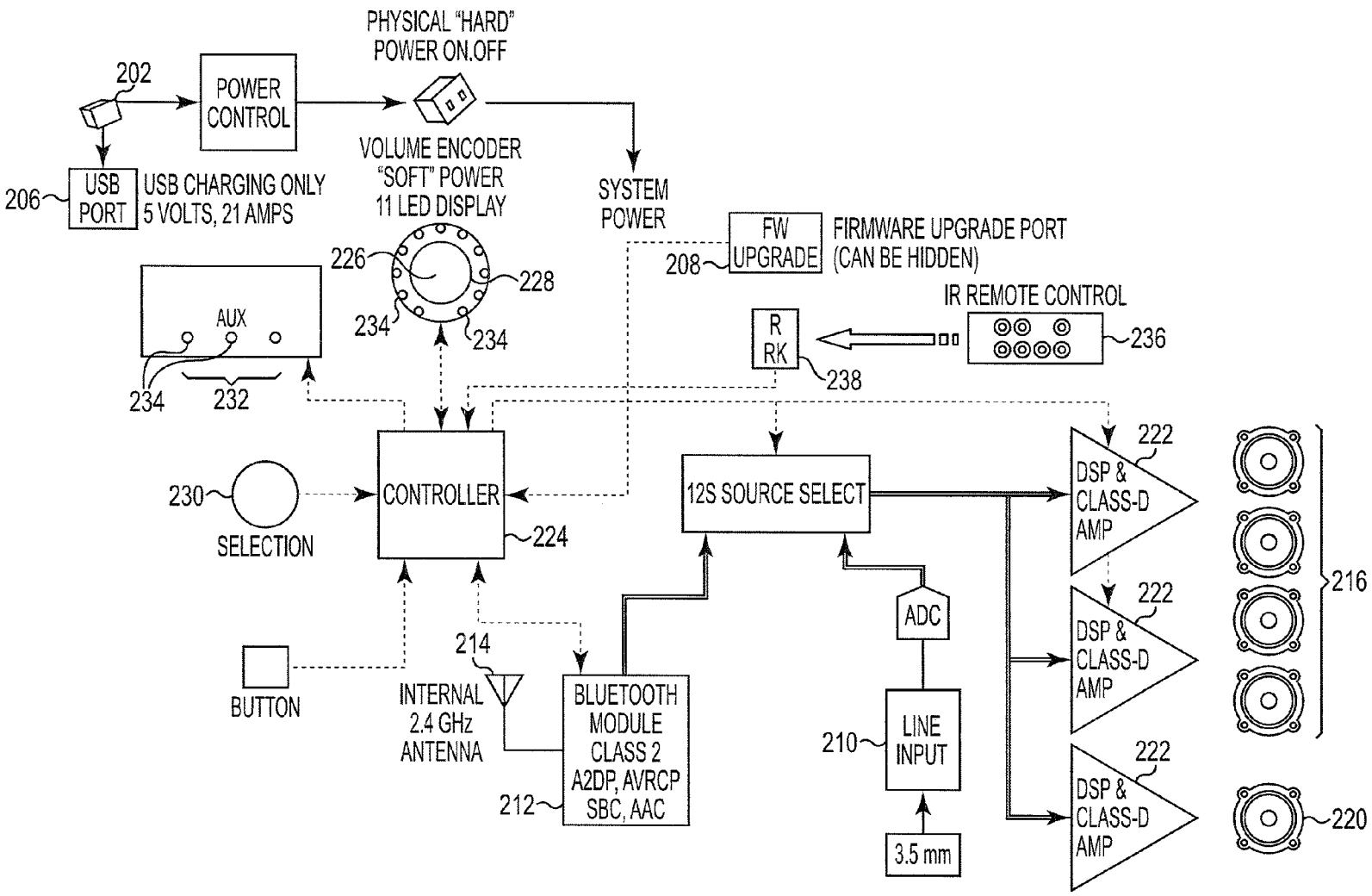
FIG. 2 is a schematic diagram of an audio player and speaker system according to an embodiment of the present disclosure.
Figure 3:
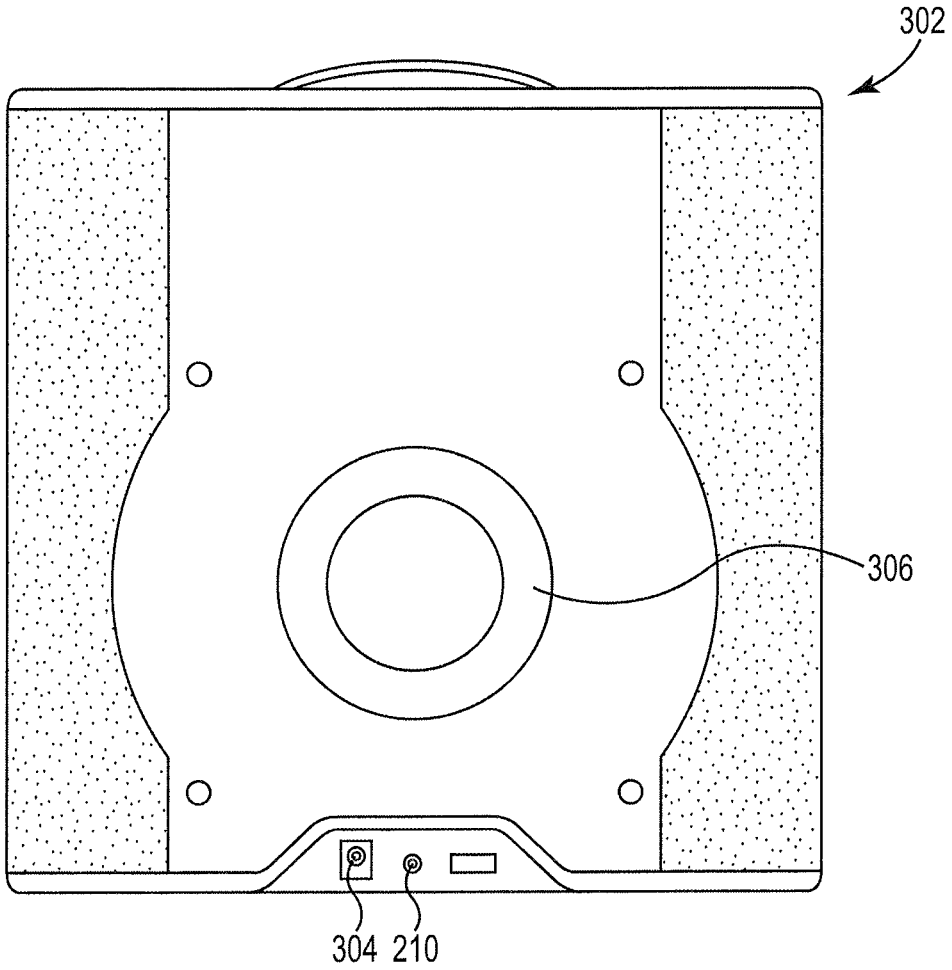
FIG. 3 is a rear panel view of an audio player and speaker system according to an embodiment of the present disclosure.

As illustrated in FIG. 2, the audio player and speaker system 100 may be removably connected to an external power source 202, such as an AC power source for operational functions. As illustrated in FIG. 3, which shows a back panel 302 of the audio player and speaker system 100, a power adapter port 304, such as but not limited to a DC power jack, may be provided for removably connecting the audio player and speaker system via a removably connectable external power adapter to an external power source. In still other embodiments, a power cord or power adapter may be permanently or integrally connected with the audio player and speaker system 100, an opposite end of which may be connected to an external power source, such as an AC power source. In additional embodiments, the audio player and speaker system 100 may also include an internal power source, which in some embodiments, may be one or more batteries, including one or more rechargeable batteries.

In some embodiments, the audio player and speaker 100 may also include a charging port 206 for recharging an external device, such as but not limited to, a portable media player, a mobile phone or smartphone, etc. In some embodiments, as may be seen in FIG. 2, the charging port 206 may be a USB port, such as a female USB port to which the external device may be removably connected via a USB connector cord. The charging port 206 for external devices, as illustrated in FIG. 2, may be provided on or at the external power adapter. However, in additional or alternative embodiments, the charging port 206 may be provided on or at the audio player housing.

In some embodiments, the charging port 206, such as a USB port, may be additionally configured for receiving and accepting firmware updates or upgrades. In other embodiments, a separate port 208 may be used for firmware updates or upgrades, if desired.

With reference to FIGS. 2 and 3, the audio player and speaker sound system 100 may further include an auxiliary port, or line-in port, 210 for operably connecting with an external media player to receive and play media input, such as audio input, therefrom. In one embodiment, the auxiliary port 210 may be a standard 3.5 mm stereo jack; however, any other suitable type of port may be utilized.

In additional or alternative embodiments, the audio player and speaker system 100 may be configured with capabilities for receiving wireless media or audio signals, such as but not limited to, short-range, wireless communications. One example of a suitable short-range, wireless communication technology is known as Bluetooth technology. Generally, Bluetooth technology is a short-range, wireless communications technology that is relatively simple and secure. It is now commonly available in a variety of devices, including mobile phones, computers, and other products. The Bluetooth Specification defines a uniform structure for devices to connect and communicate with each other. When two Bluetooth enabled devices connect to each other, this is referred to as "pairing." For example, Bluetooth pairing may include two Bluetooth enabled devices communicating with each other and establish a connection for Bluetooth communications. To pair the Bluetooth devices, a password or passkey may be exchanged, or a code may be shared by both Bluetooth devices, establishing that the devices (or their users) have agreed to a Bluetooth pairing between the devices. Enhanced authentication may be used, as appropriate.

In this regard, in one embodiment, when the wireless communication is accomplished by Bluetooth technology, the audio player and speaker system 100 may include an internal Bluetooth receiver module 212 and antenna 214 for receiving media or audio data from an external media source or device having Bluetooth capabilities. The Bluetooth receiver module 212 may be configured to perform Bluetooth pairing with the external media device, such as via secure simple pairing ("SSP"), as will be understood by those skilled in the art. Accordingly, the audio player and speaker system 100 may include a Bluetooth pairing mode, through which pairing between the Bluetooth receiver module 212 and the external media device may be accomplished. Once the devices are paired, the devices may automatically connect when both devices are powered "on," with Bluetooth enabled, and are in Bluetooth range. In some embodiments, the audio player and speaker system 100 may include a standby mode that may monitor for nearby Bluetooth enabled devices to which it has been paired and may automatically power "on" fully when the paired device is in range. In some embodiments, where the paired device is transmitting audio, the audio player and speaker system may also automatically begin playback received from the nearby device through the Bluetooth connection.

The audio player and speaker system 100 may include any number, type, size, and placement of speakers by which to play audio received from an external (e.g., via auxiliary port 210 or via Bluetooth) audio source and obtain a particular sound image. While not required, in one embodiment, the audio player and speaker system 100 may be configured for at least stereo sound with left, right, and optionally subwoofer channels. In other embodiments, the system could be configured for multiple sound channels and one or more subwoofer channels. In one embodiment, as shown schematically in FIGS. 2 and 4, the audio player and speaker system 100 may include four speakers/transducers/drivers 216, with one provided at or near each upper corner 402 of the audio player and speaker system. As indicated, the speakers 216 may be any suitable size; however, in one embodiment, the speakers 216 may be around 2 inches in diameter. The speakers 216 may be utilized for any range. However, in one embodiment, speakers 216 may be configured for a full range or a relatively higher range of frequencies. In some embodiments, the speakers 216 may each be configured as acoustically independent in its own substantially sealed enclosure. Additionally, in some embodiments, the enclosure of each speaker 216 may further include a passive radiator.

Figure 4:
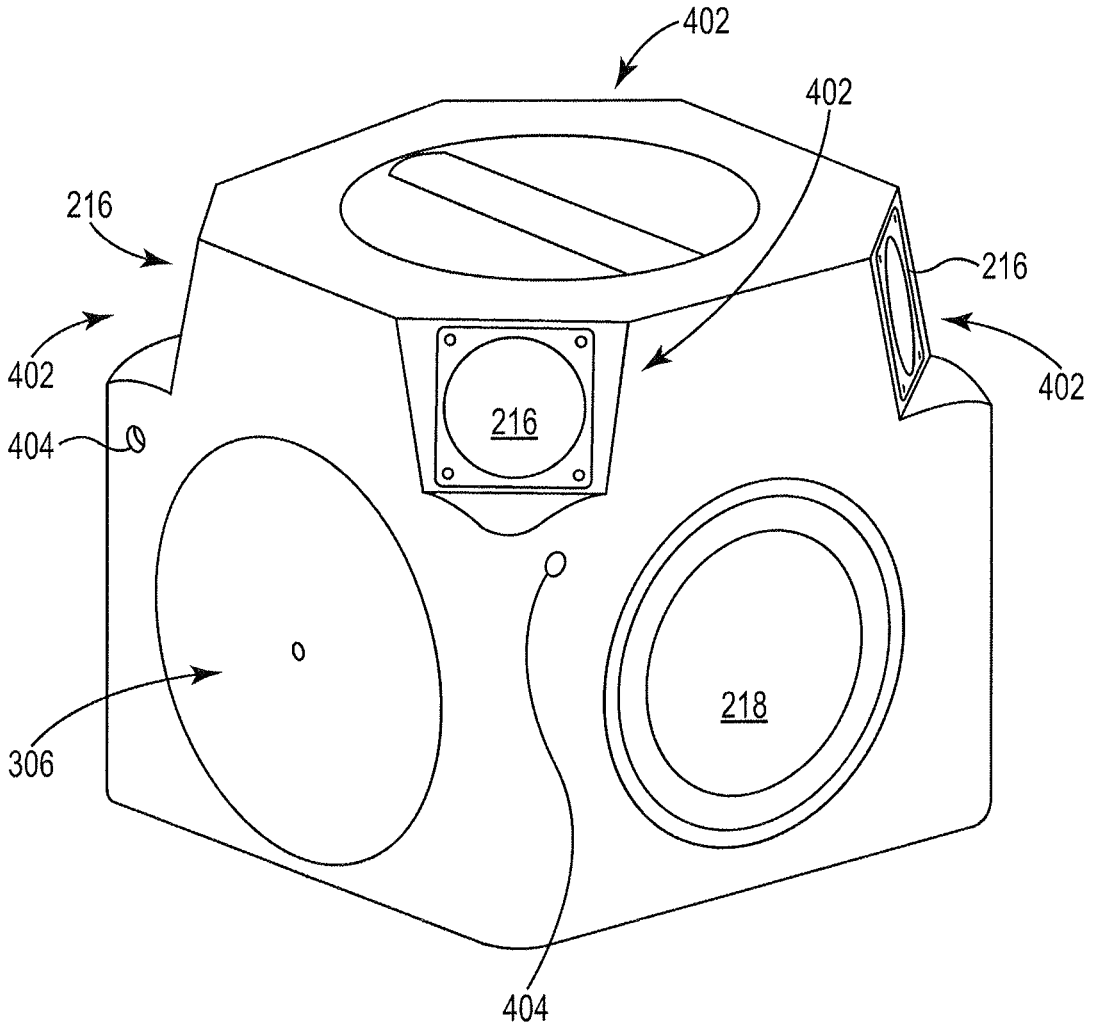
FIG. 4 is a schematic drawing of a speaker configuration for an audio player and speaker system according to an embodiment of the present disclosure.
Figure 5:
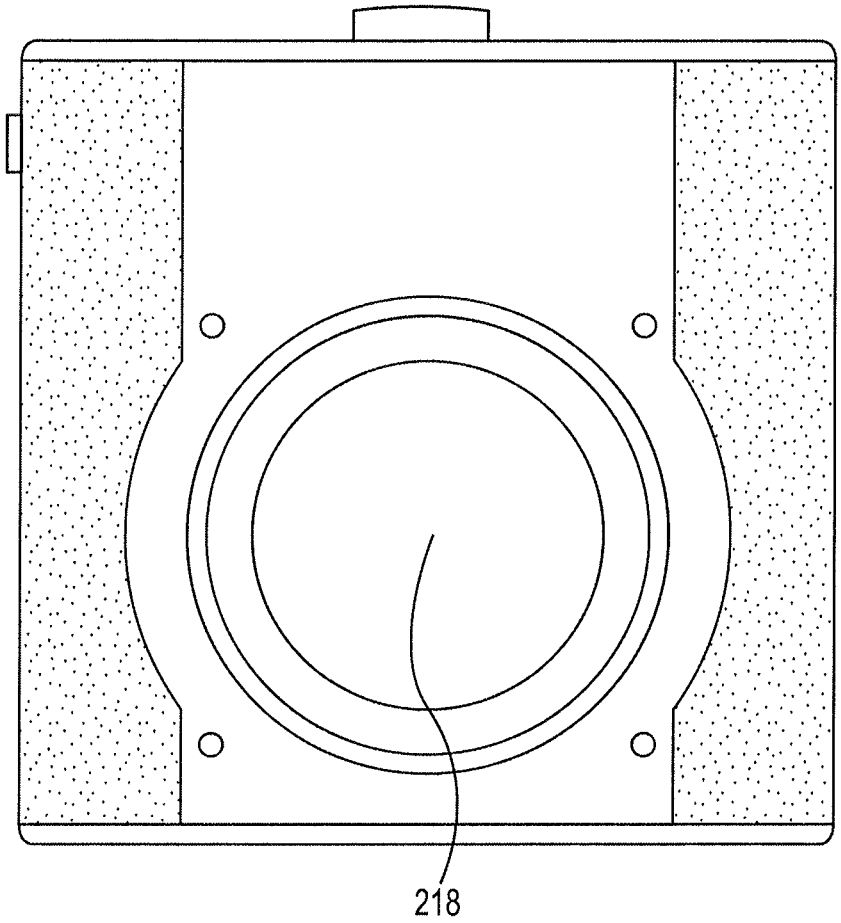
FIG. 5 is a side panel view of an audio player and speaker system according to an embodiment of the present disclosure.

In some embodiments, the audio player and speaker system 100 may include one or more relatively larger drivers/speakers or passive radiators positioned on one or more sides of the audio player and speaker system. For example, as illustrated in FIGS. 1, 4, and 5, the audio player and speaker system 100 may include a passive radiator 218 on each of the front, left, and right panels. As indicated, the additional speakers or passive radiators 218 may be any suitable size; however, in one embodiment, the passive radiators 218 may be around 5¼ inches in diameter. Of course, any other configuration of additional drivers/speakers or passive radiators is within the spirit and scope of the present disclosure, and may depend on the sound image desired.

The audio player and speaker system 100 may also include a larger speaker/transducer/driver 220, which may be positioned near the bottom of the audio player and speaker system, and which may be mounted in a vented enclosure. In one embodiment, the speaker 220 may be around 4 inches in diameter; however, other sizes are certainly suitable. The speaker 220 may also, in some embodiments, be utilized as a subwoofer. In one embodiment, the speaker 220 may be driving a bandpass enclosure, which may be tuned with the passive radiators and/or a reflex port/tube 306.

Although particular speaker arrangements have been discussed, as mentioned above, it is recognized that any number, type, size, and placement of speakers may be utilized as desired. Similarly, any of the speakers or passive radiators may include speaker grill covers. The system may also include any suitable number of audio reflex ports/tubes 306 for creating a desired sound image, such as additional reflex ports/tubes 404 for speakers 216.

The speakers may be driven utilizing any suitable number of audio amplifiers 222. In one embodiment, in conjunction with speakers 216 and 220, the amplifiers 222 may be configured to provide four full range or higher range channels and a subwoofer channel. However, it is recognized that the speakers and amplifiers may be used in any desirable configuration as desired for the application.

With reference to FIG. 2, the audio player and speaker system 100 may include a controller 224 for controlling the functions of the audio player and speaker system 100. The controller 224 may be a microprocessor or may be any other suitable combination of hardware or electric circuit components and/or software or software modules. A user interface or one or more controls may be provided to interface with the controller 224 so as to direct the controller to perform a particular function.

Figure 6:
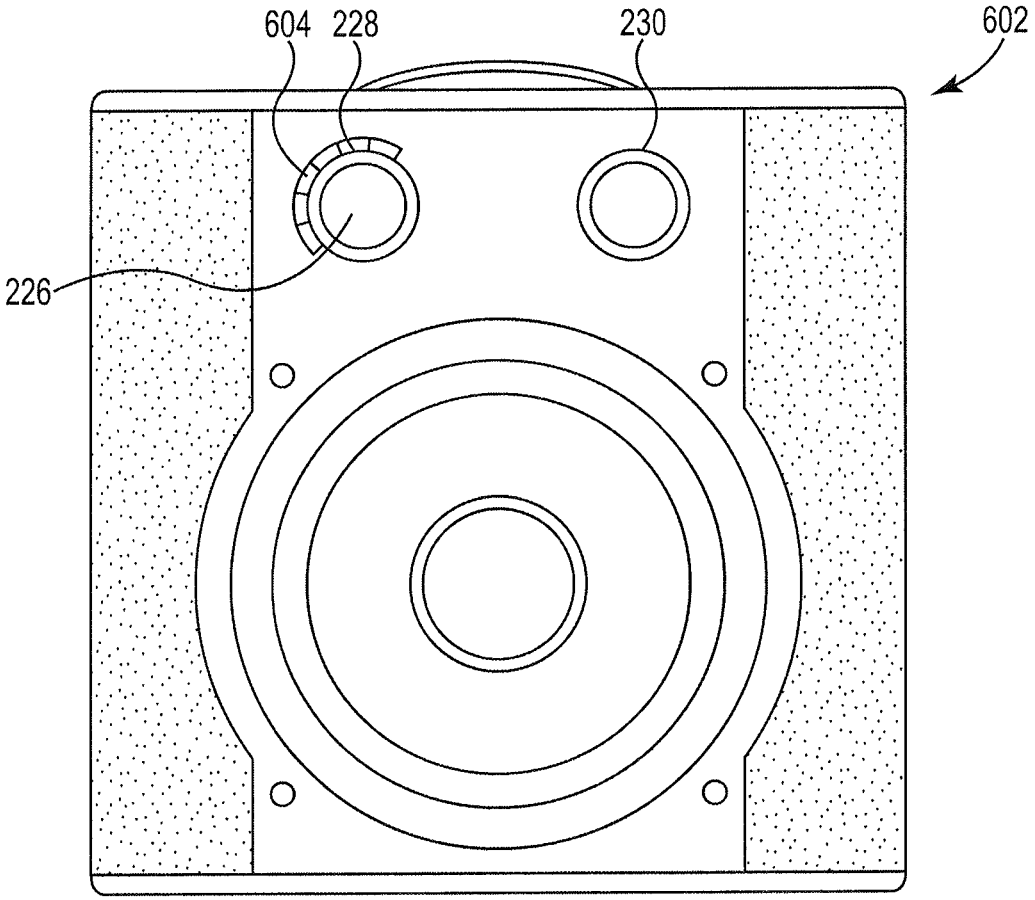
FIG. 6 is a front control panel view of an audio player and speaker system according to some embodiments of the present disclosure.

An example interface having one or more controls is illustrated in FIG. 6. However, it is recognized that any suitable interface and/or combination of controls may be utilized, and those shown in the figures are merely for illustrative purposes to assist in description of some embodiments of the present disclosure and are not intended to be limiting. As may be seen from FIG. 6, for example, a front panel 602 of the audio player and speaker system 100 may comprise one or more controls, such as buttons, dials, switches, and the like, which provide an interface through which the user may interact with the audio player and speaker system.

As illustrated in FIG. 2, the audio player and speaker system 100 may include, for example, a power button 226 or other control mechanism for powering the audio player and speaker system "on" and "off." The audio player and speaker system 100 may also include a volume control mechanism 228 for controlling the volume level. In one embodiment, the volume control mechanism may be a volume control dial, the turning of which changes the volume. As illustrated in FIG. 6, the power button 226 and volume control dial 228 may be the same control mechanism. However, in other embodiments, the power control and volume control could be separate. There may be any suitable number of volume levels, as may be desired. In one non-limiting embodiment, for example, there may be 32 or more discrete volume levels, and more preferably 64 or more discrete volume levels. The volume step size of each level need not be uniform. In another non-limiting embodiment, for example, there may be approximately 11 volume levels, such as volume levels of 0% (mute), 10%, 20%, 30%, 40%, 50%, 60%, 70%, 80%, 90%, 100%, or any variation thereof.

As also illustrated in FIGS. 2 and 6, for example, the audio player and speaker system 100 may include a source selector control 230, such as but not limited to, a source selector push button or control dial, for a user to select the audio source from which the audio player and speaker system is to receive and play audio. A user may select an audio source, for example, by pressing on the source selector push button to toggle between two or more audio sources. As discussed above, in one embodiment of the audio player and speaker system 100, audio may be received and played from an external media device via auxiliary port 210 or an external media device via wireless communication, such as but not limited to Bluetooth communication. Accordingly, in one embodiment, the source selector control 230 may be used to toggle between audio received from the auxiliary port 210 or via Bluetooth communication. In some embodiments, if the external source is Bluetooth enabled but has not yet been paired with the audio player and speaker system 100, the source selector may also be used to initiate pairing mode. In alternative embodiments, the audio player and speaker system 100 may have a separate control mechanism for initiating Bluetooth pairing mode.

In some embodiments, the source selector control may also operate as a speaker/tone configuration control for a user to select between sound profiles/speaker configurations and/or adjust sound/tone characteristics. A user may select between sound profiles/speaker configurations and/or adjustable sound characteristics, for example, by pressing on the source selector control 230 push button to toggle between the sound profiles/speaker configurations and/or adjustable sound characteristics. In other embodiments, the speaker/tone configuration control could be a separate control mechanism, such as but not limited to, an additional push button or control dial.

In one non-limiting embodiment, for example, using the speaker/tone configuration control feature of the source selector control 230, the user may be able to select between multiple sound profiles, such as a first sound profile and a second sound profile. The first sound profile may relate to a first speaker configuration, for example but not limited to, where all full range speakers 216 are driven, providing an omni-directional sound image. The second sound profile may relate to a speaker configuration, for example but not limited to, where only some of the full range speakers 216 are driven, or some of the full range speakers are driven at a reduced power, providing a more directed or directional sound image. Of course, any suitable number of sound profiles may be provided and each profile may relate to any suitable speaker configuration, such as but not limited to, where some or all of the speakers are driven and others are not driven or are driven at reduced power, or where the speakers are switched between mono and stereo sound.

Similarly, in one non-limiting embodiment, for example, using the speaker/tone configuration control feature of the source selector control 230, the user may be able to select between adjustable sound characteristics. For example, the user may be able to select between treble and bass adjustment, fade adjustment, etc. Once an adjustable sound characteristic is selected, an additional control mechanism may be utilized to adjust the level of the selected sound characteristic. In one embodiment, an existing control mechanism, such as the volume control dial discussed above, may be utilized to adjust the level of the selected sound characteristic.

The audio player and speaker system 100 may also include one or more visual indicators 232 so as to provide information to the user. The visual indicators 230 may be provided by any suitable means, such as via one or more LEDs 234, one or more LCD displays, etc. Such visual indicators 232 may include, but are not limited to, any or all of the following:

Volume level indicator: an indicator may be provided to indicate the volume level of the audio player and speaker system. In one example embodiment, the indicator may include a plurality of aligned LEDs that indicate the volume level by how many of the LEDs are lit. In a further embodiment, the plurality of aligned LEDs may be aligned in circular or semi-circular fashion 604, and may be located near or around the volume control dial discussed above. However, other suitable configurations of the visual indicator are within the spirit and scope of the present disclosure.

Bluetooth Indicator: an indicator may be provide Bluetooth status information, such as but not limited to, whether an Bluetooth enabled external media device is nearby, paired, and/or connected, etc. In an example embodiment, the indicator may include one or a series of LEDs. However, other suitable configurations of the visual indicator are within the spirit and scope of the present disclosure.

Source Indicator: an indicator may be provided to indicate the audio source selected, for example, by the source selection control. In one example embodiment, the indicator may include one or more LEDs that identify the source selected. However, other suitable configurations of the visual indicator are within the spirit and scope of the present disclosure.

Speaker/Tone Configuration Indicator: an indicator may be provided to indicate the selected speaker/tone configuration and/or adjustable sound characteristic selected for adjustment. In one example embodiment, the indicator may include one or more LEDs that identify the selected configuration or adjustable sound characteristic. In a further embodiment, as discussed above, where the volume dial may be used to adjust a particular sound characteristic, the volume indicator may also be used as the level indicator for the sound characteristic being adjusted. In other embodiments, a separate level indicator may be utilized. However, other suitable configurations of the visual indicator are within the spirit and scope of the present disclosure.

In other embodiments, other types of feedback, such as but not limited to, tactile or audio feedback, may be used to provide indications for any of the above information in addition to, or in alternative to, the visual indicators discussed above, as may be desired.

In one embodiment, the audio player and speaker system 100 may include a remote control 236 for remotely controlling one or more of the above-described functions or other functions, such as but not limited to, power control, volume control, source selection, speaker/tone configuration, etc., of the audio player and speaker system, as would be understood by those skilled in the art. Accordingly, the audio player and speaker system 100 may further include a wireless receiver 238, such as but not limited to, an infrared receiver, for receiving signals from the remote control 236. In additional or alternative embodiments, a mobile application, often referred to as an "app," may be provided for a user to download to the external media device, such as but not limited to, a smartphone, through which the audio player and speaker system 100 may communicate and provide remote control functionality for above-described functions or other functions.

Figure 7A:
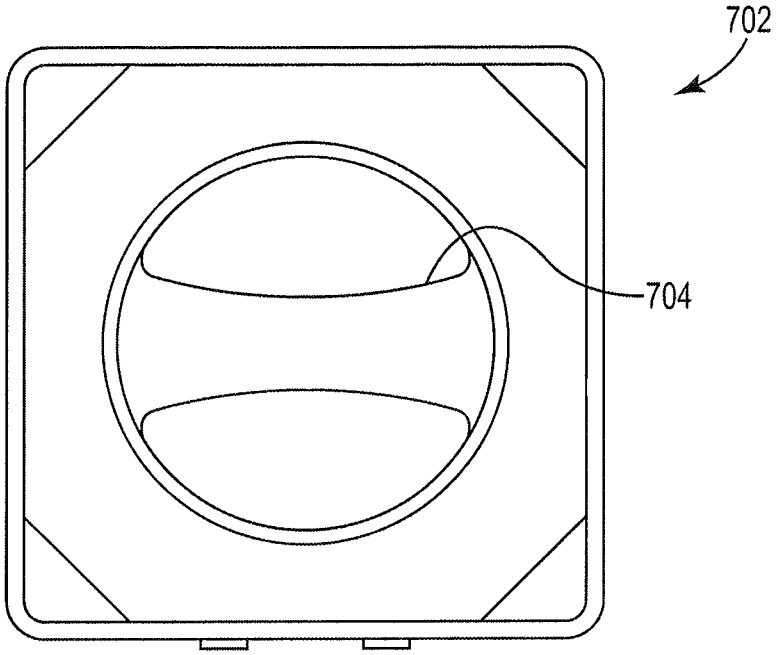
FIGS. 7*a* and 7*b* are top panel views of an audio player and speaker system according to an embodiment of the present disclosure.
Figure 7B:
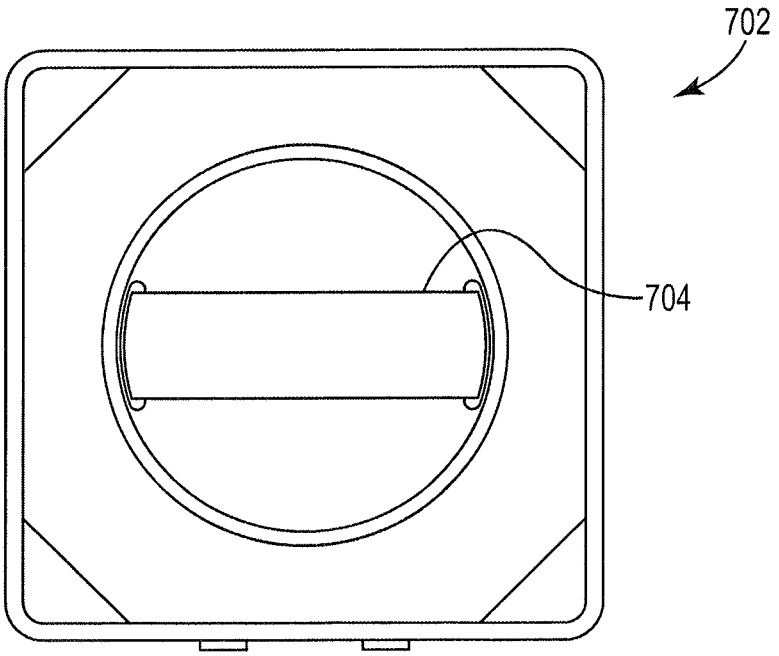

In some embodiments, as illustrated in FIGS. 7*a* and 7*b*, which show a top panel 702, the audio player and speaker system 100 may include an integral handle 704. The integral handle 704 may permit the audio player and speaker system 100 to be more conveniently moveable. In some embodiments, as illustrated particularly in FIG. 7*a*, the integral handle 704 may be an integral plastic handle. In other embodiments, however, such as that shown in FIG. 7*b*, the integral handle 704 may be made from any suitable material, such as rubber, leather, flexible plastic, etc., or any combination thereof, and may be integrally attached to the housing of the audio player and speaker system 100.

Figure 9:
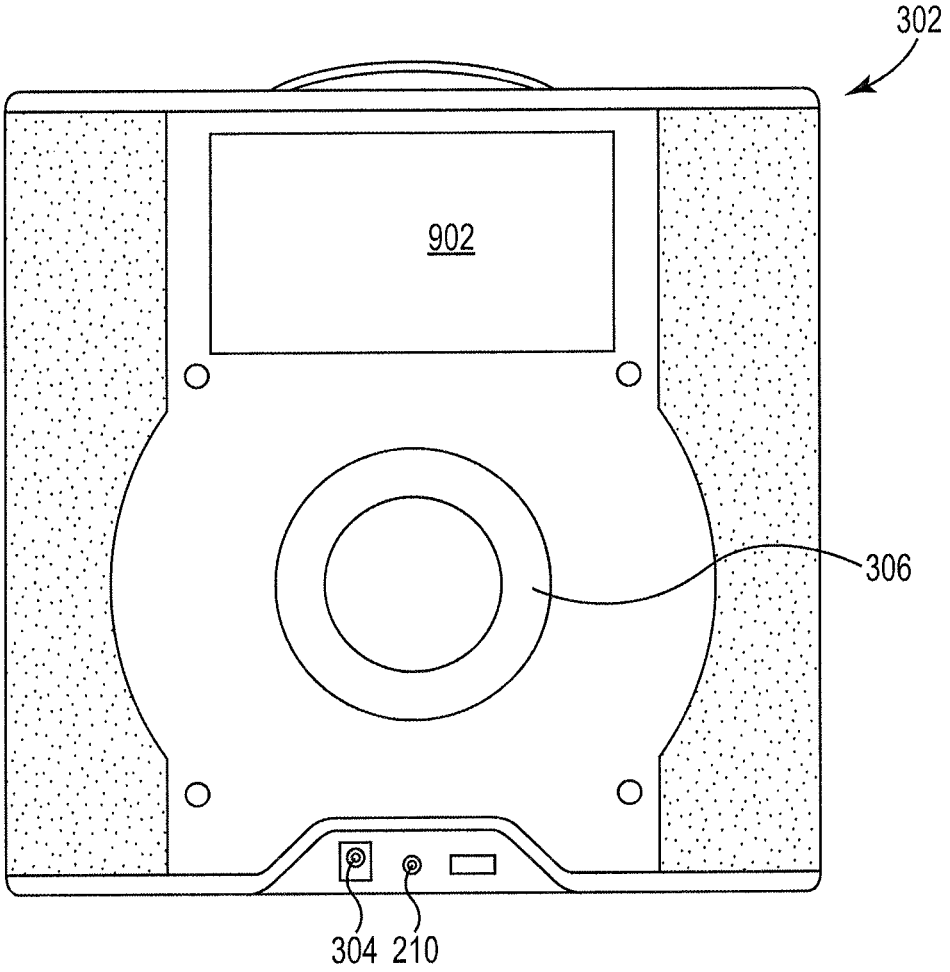
FIG. 9 is a rear panel view of an audio player and speaker system with a video display screen, according to another embodiment of the present disclosure.

In some embodiments, the systems contain a video display in addition to audio capabilities, where said video display is configured to play movies, videos, television programming, music videos, other video files, and the like. The video display, as shown at 902 in FIG. 9, can be positioned anywhere on the device as is desired, and can be any suitable shape and size. It can provide black-and-white or color images, in any desired resolution level, including three-dimensional video.

In the foregoing description, various embodiments of the invention have been presented for the purpose of illustration and description. They are not intended to be exhaustive or to limit the invention to the precise form disclosed. Obvious modifications or variations are possible in light of the above teachings. The embodiments were chosen and described to provide the best illustration of the principals of the invention and its practical application, and to enable one of ordinary skill in the art to utilize the invention in various embodiments and with various modifications as are suited to the particular use contemplated. All such modifications and variations are within the scope of the invention as determined by the appended claims when interpreted in accordance with the breadth they are fairly, legally, and equitably entitled.

We claim:

1. An audio playback system, comprising:

a housing having front, back, left side, right side, top, and bottom panels;

a plurality of passive radiators or ports positioned in one or more of the front, left side, and right side panels of the housing;

a plurality of speakers or transducers provided in the housing, the plurality of speakers or transducers configured for at least stereo sound, wherein each of the speakers or transducers is configured for a full range of frequencies or a relatively higher range of frequencies and at least one of the speakers or transducers is configured for driving a bandpass enclosure tuned with at least one of the passive radiators or ports;

a short-range, wireless communication module configured for receiving audio data from an external audio source comprising a media device, wherein the plurality of speakers or transducers is configured to play audio from the external audio source;

a controller configured for directing the audio for playback at the plurality of speakers or transducers based on the audio data, and to select a sound profile relating to a configuration of the speakers or transducers by which to play the audio to obtain a particular sound image; and a selector control mechanism for selecting between an omni-directional sound image in which all full range speakers or transducers are driven and a directional sound image in which only some of the full range speakers or transducers are driven or some of the full range speakers or transducers are driven at reduced power.

2. The audio playback system of claim 1, wherein:

the system is configured to monitor for the media device in a standby mode;

said short-range, wireless communication module is configured to perform Bluetooth pairing with the media device; and the system is configured to automatically power on and begin playback when the media device is in range and transmitting the audio.

3. The audio playback system of claim 1, wherein the media device provides remote control functionality for control of the selected sound image.

4. The audio playback system of claim 1, wherein said external audio source comprising the media device is selected from the group consisting of a portable media player, a smartphone, a tablet computer, and a personal computer.

5. The audio playback system of claim 1, further comprising a subwoofer channel comprising the at least one of the speakers or transducers configured for driving the bandpass enclosure.

6. The audio playback system of claim 1, further comprising a charging port adapted to connect to and recharge the external audio source comprising the media device.

7. The audio playback system of claim 6, wherein said charging port is a USB port configured for firmware updates.

8. The audio playback system of claim 1, further comprising a video display configured to play video files and provide color images including three-dimensional video.

9. An audio playback system, comprising:

a housing having front, back, left side, right side, top, and bottom panels;

a plurality of passive radiators or ports positioned in one or more of the front, left side, and right side panels of the housing;

a plurality of speakers or transducers provided in the housing, each of the speakers or transducers configured for a full range of frequencies or a relatively higher range of frequencies and at least one of the speakers or transducers configured for driving a bandpass enclosure tuned with at least one of the passive radiators or ports;

a reflex tube configured to tune the bandpass enclosure;

a short-range, wireless communication module configured for receiving audio data from an external audio source comprising a media device, wherein the plurality of speakers or transducers is configured to play audio from the external audio source;

a controller configured for receiving audio data from the communication module and directing the audio for playback at the plurality of speakers or transducers based on the audio data to obtain a particular sound image; and a configuration control configured to select between sound profiles relating to a configuration of the speakers or transducers by which to play the audio to obtain the particular sound image;

wherein a first one of said sound profiles provides an omnidirectional sound image in which all full range speakers or transducers are driven and a second one of said sound profiles provides a directional sound image in which only some of the full range speakers or transducers are driven or some of the full range speakers or transducers are driven at reduced power.

10. The audio playback system of claim 9, wherein:

the system is configured to monitor for the media device in a standby mode;

said short-range, wireless communication module is configured to perform Bluetooth pairing with the media device; and the system is configured to automatically power on and begin playback when the media device is in range and transmitting the audio.

11. The audio playback system of claim 9, further comprising a subwoofer channel comprising the at least one of the speakers or transducers configured for driving the bandpass enclosure.

12. The audio playback system of claim 9, further comprising a charging port adapted to connect to and recharge the external audio source comprising the media device.

13. The audio playback system of claim 12, wherein said charging port is a USB port configured for firmware updates.

14. The audio playback system of claim 9, further comprising a video display configured to play video files, wherein the media device provides remote control functionality for control of the particular sound image.

15. The audio playback system of claim 1, wherein the plurality of speakers or transducers includes speakers or transducers provided at upper corners of the housing.

16. The audio playback system of claim 1, wherein the selected sound profile relates to a configuration where only some of the full range speakers or transducers are driven and others of the full range speakers or transducers are not driven to provide the directional sound image.

17. The audio playback system of claim 1, wherein the selected sound profile relates to a configuration where some of the full range speakers or transducers are driven at reduced power to provide the directional sound image.

18. The audio playback system of claim 9, wherein four of the speakers or transducers are provided at upper corners of the housing and the selected sound profile relates to a configuration where some of the speakers or transducers are driven at reduced power to provide the directional sound image.

19. The audio playback system of claim 9, wherein each of the speakers or transducers is configured as acoustically independent in its own substantially sealed enclosure.

20. The audio playback system of claim 19, wherein each substantially sealed enclosure includes a passive radiator.

21. An audio playback system, comprising:

a housing having front, back, left side, fight side, top, and bottom panels;

a plurality of passive radiators or ports positioned in one or more of the front, left side, and right side panels of the housing;

a plurality of speakers or transducers provided in the housing, at least one of the speakers or transducers configured for driving a bandpass enclosure tuned with at least one of the passive radiators or ports;

wherein each of the speakers is configured as acoustically independent in its own substantially sealed enclosure, each substantially sealed enclosure including a passive radiator;

a reflex tube configured to tune the bandpass enclosure;

a short-range, wireless communication module configured for receiving audio data from an external audio source comprising a media device, wherein the plurality of speakers or transducers is configured to play audio from the external audio source;

a controller configured for receiving audio data from the communication module and directing the audio for playback at the plurality of speakers or transducers based on the audio data to obtain a particular sound image; and a configuration control configured to select between more than one sound profiles relating to a configuration of the speakers or transducers by which to play the audio to obtain the particular sound image;

wherein:

the system is configured to monitor for the media device in a standby mode;

said short-range, wireless communication module is configured to perform Bluetooth pairing with the media device; and the system is configured to automatically power on and begin playback when the media device is in range and transmitting the audio.

* * * * *